US009470075B2

(12) United States Patent
Morrow

(10) Patent No.: US 9,470,075 B2
(45) Date of Patent: Oct. 18, 2016

(54) SYSTEM AND METHOD FOR DIRECT DRIVE PUMP

(71) Applicant: Harrier Technologies, Inc., Greenwich, CT (US)

(72) Inventor: William Bruce Morrow, Santa Barbara, CA (US)

(73) Assignee: Harrier Technologies, Inc., Greenwich, CT (US)

( * ) Notice: Subject to any disclaimer, the term of this patent is extended or adjusted under 35 U.S.C. 154(b) by 464 days.

(21) Appl. No.: 13/967,758

(22) Filed: Aug. 15, 2013

(65) Prior Publication Data

US 2013/0330211 A1 Dec. 12, 2013

Related U.S. Application Data

(63) Continuation-in-part of application No. 13/726,589, filed on Dec. 25, 2012, now abandoned, which is a continuation of application No. 12/552,806, filed on Sep. 2, 2009, now Pat. No. 8,336,632.

(51) Int. Cl.

| | |
|---|---|
| ***E21B 43/12*** | (2006.01) |
| ***F04D 13/10*** | (2006.01) |
| ***F04D 29/046*** | (2006.01) |
| ***F04D 29/043*** | (2006.01) |
| ***F04D 29/044*** | (2006.01) |

(52) U.S. Cl.

CPC ..... *E21B 43/126* (2013.01); *F04D 13/10* (2013.01); *F04D 29/043* (2013.01); *F04D 29/044* (2013.01); *F04D 29/046* (2013.01)

(58) Field of Classification Search

CPC .. E21B 43/121; E21B 43/126; E21B 43/129; E21B 19/16; E21B 17/1071; F04D 13/10; F04C 13/008; F04B 47/02

USPC ..... 166/380, 382, 68, 105; 417/360, 423.3, 417/424.1

See application file for complete search history.

(56) References Cited

U.S. PATENT DOCUMENTS

| | | | | |
|---|---|---|---|---|
| 2,171,171 | A | 8/1939 | Brauer | |
| 4,957,161 | A | 9/1990 | Cholet | |
| 4,993,276 | A * | 2/1991 | Edwards | E21B 43/121 166/78.1 |
| 5,069,284 | A | 12/1991 | Gray | |
| 5,309,998 | A | 5/1994 | Rivas et al. | |
| 5,960,886 | A | 10/1999 | Morrow | |
| 6,106,224 | A * | 8/2000 | Sheth | F04D 29/0413 415/104 |
| 6,413,065 | B1 | 7/2002 | Dass | |
| 6,454,010 | B1 | 9/2002 | Thomas et al. | |
| 6,523,624 | B1 | 2/2003 | Cousins et al. | |
| 6,729,391 | B2 | 5/2004 | Hill et al. | |
| 6,796,390 | B1 | 9/2004 | Bakker | |
| 6,966,366 | B2 | 11/2005 | Rogers, Jr. | |
| 8,336,632 | B2 | 12/2012 | Morrow et al. | |
| 8,960,273 | B2 * | 2/2015 | Bara | F04D 13/10 166/105 |
| 2006/0000605 | A1 | 1/2006 | Jordan et al. | |
| 2010/0166578 | A1 | 7/2010 | Watson | |
| 2012/0020777 | A1 * | 1/2012 | Eslinger | F04D 1/063 415/170.1 |
| 2013/0209225 | A1 * | 8/2013 | Eslinger | F04D 7/04 415/104 |
| 2013/0330211 | A1 * | 12/2013 | Morrow | E21B 43/126 417/62 |

* cited by examiner

OTHER PUBLICATIONS

PCT International Search Report for PCT/US2010/045377, Oct. 8, 2010, pp. 1-8, USA.

*Primary Examiner* — Daniel P Stephenson

(74) *Attorney, Agent, or Firm* — Keith D. Nowak; Carter Ledyard & Milburn LLP

(57) ABSTRACT

A direct drive pump employs an on-off tool to attach the drive rod string to a floating pump drive shaft in both torsion and tension. The downward thrust on the drive shaft, as well as the weight of the drive rod string, is born by a thrust bearing in the drivehead at the surface. A floater pump is used with this direct drive pump to permit the free vertical movement of the drive shaft. When a tandem direct drive pump is employed a housing containing a tandem pump drive shaft connector connects the shafts in an upper and lower tandem pump to permit the two to freely move in the tandem direct drive pump.

5 Claims, 12 Drawing Sheets

SYSTEM AND METHOD FOR DIRECT DRIVE PUMP

The present invention relates to a system and method for a direct drive pump to be used for moving liquids and/or quasi-liquids. The present invention also relates to a system and method for the installation of a direct drive pump, for example, for high volume lifts from deep wells.

BACKGROUND

Current systems for deep well pumping involve electrical submersible pumps ("ESPs") or geared centrifugal pumps ("GCPs"). Such pumps are the current, principal methods used as artificial lifts in high rate oil wells, where a multi-stage centrifugal pump is located downhole. For example, in an ESP system, a downhole electrical motor directly drives the pump, with electric power supplied to the motor via a cable extending from the surface to the motor's location downhole. For example, in a GCP system, the pump is driven via a rotating rod string extending from the surface to a speed increasing transmission system located downhole. The speed increasing transmission system is used to increase the relatively slow rotation of the rod string to a much faster rotation, as needed by the pump. In this example, the rod string is driven by a prime mover at the surface.

In current systems, the artificial lift system tends to be a bit burdensome. For example, in the installation of a current artificial lift system, a 300 to 400 foot artificial pump is installed in 10 foot sections in assembly form. Likewise, in the maintenance of a specific section of the pipe or tubing, the entire section of the pump must be removed all at once before any maintenance can be made.

FIGS. 1A and 1B show example line shaft pumps. FIG. 1A shows a line shaft pump with water lubricated bearings. In FIG. 1A, the drive shaft is running directly inside the production tubing, or column pipe. Unlike the example shown in FIG. 1B, this pump does not use an oil pipe. Instead, in FIG. 1A, the drive shaft is centered within the column pipe by water lubricated bearings and bearing retainers attached to the column pipe. Such bearings are typically made of rubber, due to use in water. The pump thrust, as well as the weight of the drive shaft itself, are carried by a thrust bearing located at the surface.

FIG. 1B shows a line shaft pump with an oil pipe and oil lubricated bearings. In FIG. 1B, an oil lubricated drive shaft rotates inside the oil pipe, or oil filled tubular housing. The drive shaft is supported by shaft bearings, e.g., bronze bushings, attached fixedly to the oil pipe. The bushings are spaced, e.g., 5 feet to 10 feet, on the oil pipe and along the drive shaft depending upon the intended rotational speed of the drive shaft. In this example, the steel pump shaft forms the journals for the bronze bushings. The pump thrust, as well as the weight of the drive shaft itself, are carried by a thrust bearing at the surface. Accordingly, the oil pipe can be centered within the column pipe by elastomer centralizers spaced evenly along its length as shown in FIG. 1B.

In both FIGS. 1A and 1B, there is a required bearing spacing for adequate support of the drive shaft. Such spacing affects the configuration of the tubulars used in installation. For example, in a water lubricated system shown in FIG. 1A, if the drive shaft bearings are required every 10 feet, then the column pipe is used in 10 foot segments. The bearing retainers are fixed to the column pipe at the column pipe couplings. For example, in an oil lubricated system shown in FIG. 1B, if the drive shaft bearings are required every 10 feet, then the oil pipe is used in 10 foot segments. The bushings are fixed to the drive shaft housing at the housing couplings. In both examples, the pump systems can be installed in similar fashion. For example, if the bearing spacing is deemed to be 10 feet, then all of the components including the column pipe, oil pipe, and drive shaft, are in 10 foot length segments. Thus, as the pump is lowered into a well, each of the 10 foot segments of the drive shaft, bearings and column or oil pipe, must be installed in 10 foot segments.

Accordingly, a need exists for a less burdensome installation, de-installation, and maintenance of a pump system for both oil and water lubrication systems.

Figure 1A:
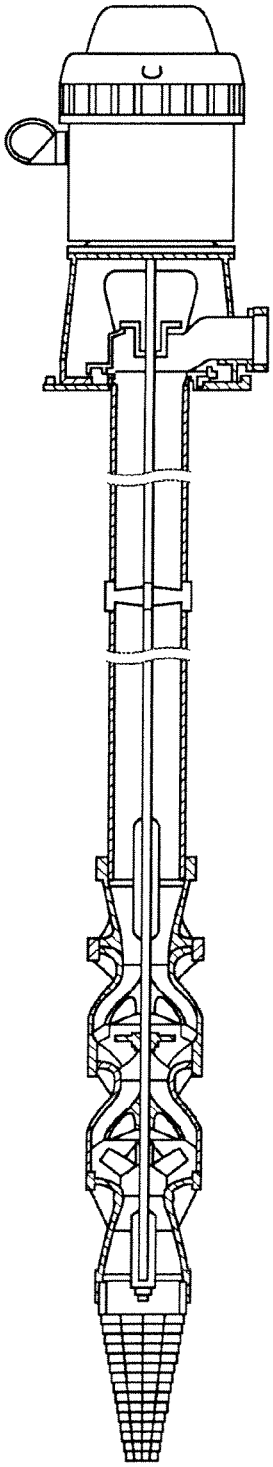
FIG. 1A shows a line shaft pump having water lubricated bearings.

Embodiments of the present invention provide for a relatively easy to install and maintain artificial lift pump for use in oil and water pump systems. More specifically, embodiments of the present invention may be used for deep well pumping of oil, water, or other fluid/quasi-fluid.

Embodiments of the present invention provide for a deep well pump system which can be utilized at a greater depth and/or with a greater rotational speed than current pump systems allow. For example, water wells tend to be relatively large in diameter, e.g., 10 inches to more than 16 inches. Accordingly, available agricultural centrifugal pumps used in water wells require large diameter pump rotor which produce a large increase in pressure per stage. That is, pressure per stage is proportional to the square of the rotor diameter, and the square of the rotational speed. Given the large diameter and typically shallow depth of a water well, water well turbine pumps typically are operated at speeds between about 1200 RPM and 1800 RPM. Comparatively, oil wells tend to use an about 5.5 inch or 7 inch production casing having an inside diameter of about 4.6 inches to 6 inches. Accordingly, available centrifugal pumps require a small diameter pump rotor, providing a small pressure increase per stage. This small pressure increase per stage results in the pump having to be operated at a high speed, e.g., about 3500 RPM. Even at such high speed, due to the small pressure increase per stage and the typically deep depth of oil wells, there can be as many as 250 or more stages required to bring the produced fluid to the surface or other desired location. If such pumps for oil production were operated at the typical speed of an agricultural pump (e.g., for a water well), about 1000 stages or more could be required to bring the produced fluid to the surface or other desired location, which would be prohibitively expensive and wearing on the system. In embodiments of the present invention, such restrictions and expense of the agricultural and oil pump systems are alleviated or diminished.

Embodiments of the present invention provide for a pump installation in which larger sections of the pump may be installed than current pump systems allow. For example, in agricultural and oil pumps, the drive shaft is stabilized by bearings that are fixed to either the tubular drive shaft housing, i.e., the oil pipe, or the column pipe. Each of these segments are made to be all the same length so that the bearings can be fixed to the column pipe or oil pipe at the junction of the segments of pipe as the pump is being installed into the well. In an oil lubricated bearing system, bronze bushings are attached to the oil pipes, with a steel drive shaft forming the journal. In a water lubricated bearing system, the rubber bearing is held in the center of the column pipe by the bearing retainers. The drive shaft runs through the rubber bearing and is fitted with a stainless steel sleeve serving as journal. In both the agricultural (e.g., water) and oil pump systems, the bearing is affixed to the column pipe or oil pipe, respectively. Accordingly, as discussed above, the installation of such available systems require assembly of each 10 feet of pump system segments. Embodiments of the present invention provide for installations of larger pump system segments, e.g., 25 foot sections, 60 foot sections, and more.

Embodiments of the present invention provide for a high volume artificial lift system, i.e., a direct drive pump ("DDP"), in which a multi-stage downhole centrifugal pump is driven by a rod string extending from the surface to the downhole pump. The rod string is driven at the surface, e.g., ground level, by a prime mover, e.g., an electric motor. For example, the motor may drive the rod string at a 3500 RPM pump operational speed. This speed can be decreased or increased, depending upon the situation needed, in embodiments of the present invention.

Embodiments of the present invention provide for closely spaced bearings to provide rotational stability of the drive string. In an embodiment, the individual bearings are attached to the drive string, and are not fixed to the production casing or drive tube.

Figure 2:
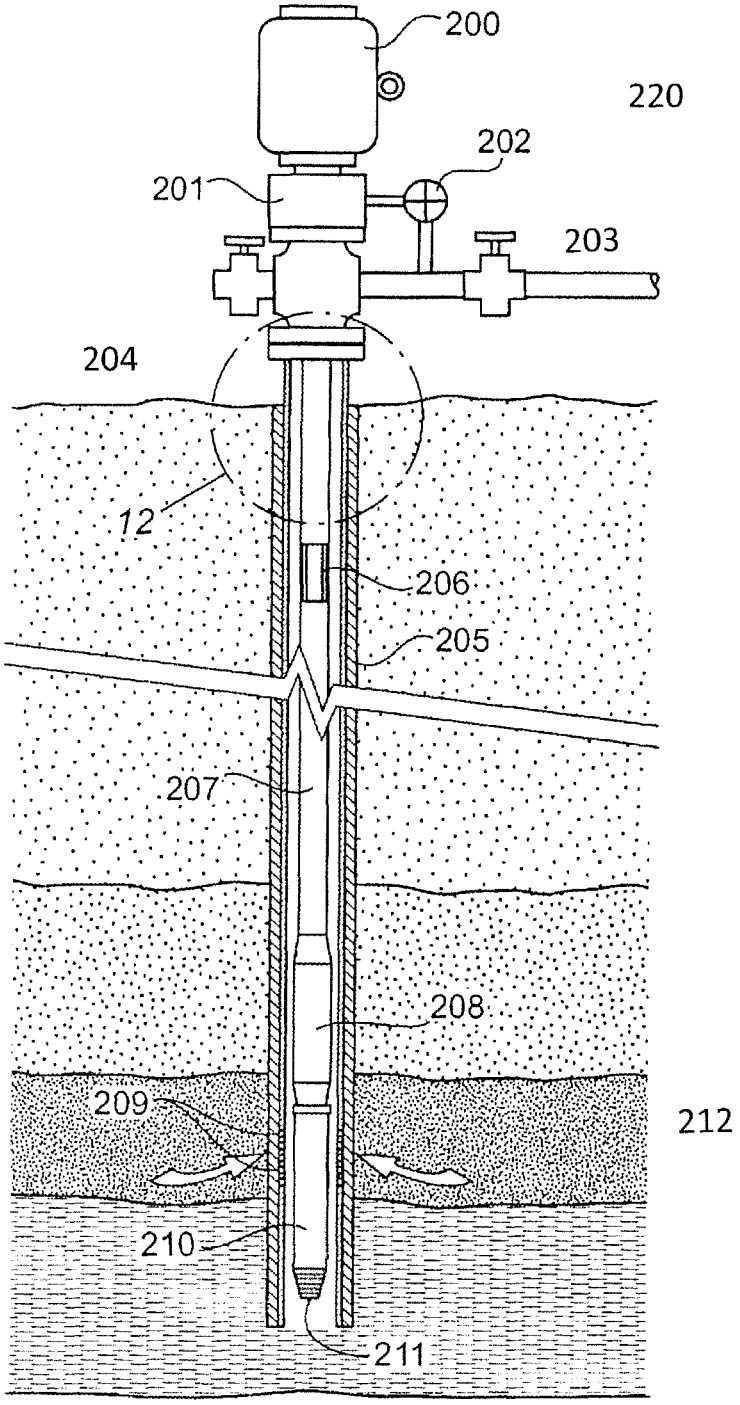
FIG. 2 shows an exemplary embodiment of a direct drive pump according to an embodiment of the present invention.

FIG. 2 shows an embodiment of a direct drive pumping system 220 according to the present invention. In FIG. 2, a motor 200 is shown connected to the remaining elements of the pump via tubing hangers and at least one thrust bearing 201. In an embodiment, the motor 200 is an electric motor which drives the rod string at full pump speed. Alternatively, the motor 200 is a direct drive motor, e.g., turning at 3500 RPM. Alternatively, the motor 200 has a low output RPM, i.e., lower than 3500 RPM, but with speed increasing capability gearing. In this embodiment, the pressure of the pump system is monitored by a pressure regulator 202 situated between the pump and the flow line 203 to the pump. The pressure regulator 202 opens when the pressure differential between the drive tube and the production tubing exceeds a predetermined, set value. A wellhead 204 couples the well casing to the upper portion of the pump system which includes the motor 200 and the flow line pipe 203. Inside the protective well casing 205, a production tubing or pipe 207 is situated and houses a drive rod string 206. The lower portion of the pump system includes a receiver and thrust bearing(s) 208. In an embodiment, the thrust bearing 208 carrying the weight of the drive rods is located in the surface drive head. Due to the high rotational speed, the rod string 206 is equipped with stabilizers or bearings closely spaced along the entire length of the rod string to assure stable rotation. Some example embodiments of such stabilizers are shown herein. Perforations 209 in the well casing in the pay zone 212 area, i.e., where the water or oil or other liquid/quasi-liquid is located, allow for entry of the liquid or quasi-liquid into the well casing for pumping via the pump 210 having a pump inlet 211, up to the surface or other desired location.

Figure 3:
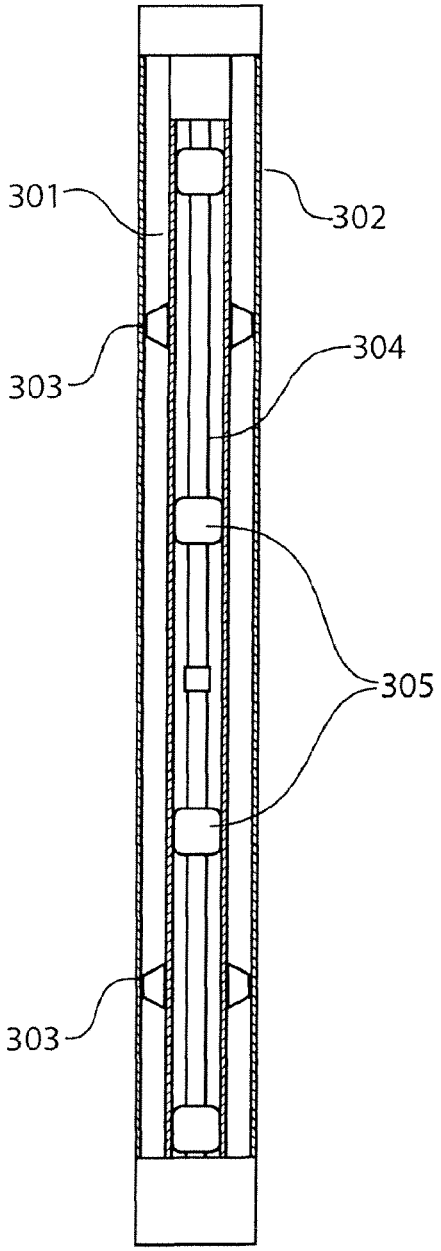
FIG. 3 shows an exemplary embodiment of a drive rod with a drive tube according to an embodiment of the present invention.

FIG. 3 shows an embodiment of a drive rod 304 having a drive tube 301 according to an embodiment of the present invention. For example, in larger sizes of production tubing, the drive rod string 304 and stabilizers 305 rotate within a small diameter tubular housing called a drive tube 301. The drive tube 301 runs inside the production tubing 302. In order to stabilize the drive tube 301, drive tube stabilizers 303 are spaced between the production tubing 302 and the drive tube 301. Within the drive tube 301 itself, the drive rod string 304 is supported by drive rod stabilizers 305 to the drive tube 301.

Figure 4:
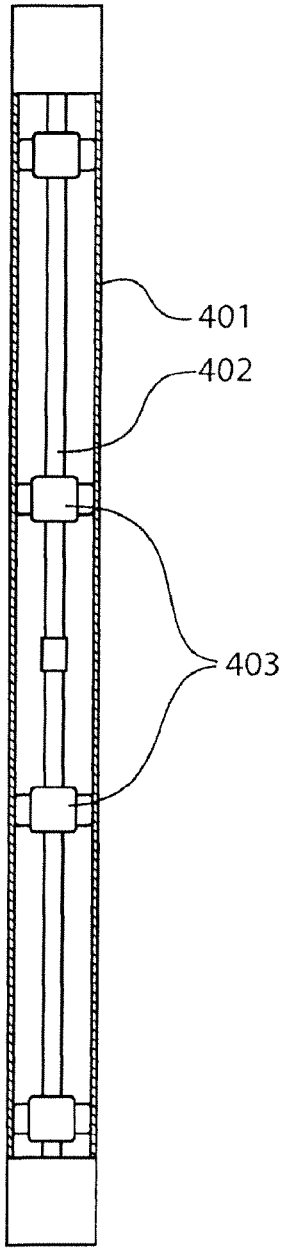
FIG. 4 shows an exemplary embodiment of a drive rod without a drive tube according to an embodiment of the present invention.

FIG. 4 shows an embodiment of a drive rod string 402 being encased directly in production tubing 401. In such case, the drive rod string 402 is supported by drive rod stabilizers 403 to the production tubing 401. Such an embodiment may be used in the situation of a relatively small diameter production tubing, where there is insufficient and/or no need for a drive tube.

Figure 5A:
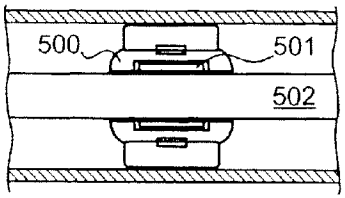
FIG. 5A shows a cross-sectional view of a stabilizer embodiment for the direct drive pump according to an embodiment of the present invention.
Figure 5B:
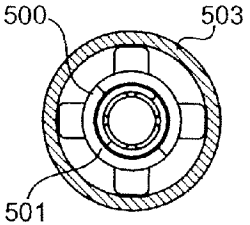
FIG. 5B shows a top view of a stabilizer embodiment for the direct drive pump according to the embodiment of the present invention shown in FIG. 5A.
Figure 5C:
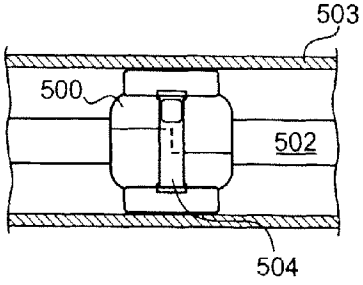
FIG. 5C shows a front view of a stabilizer embodiment for the direct drive pump according to the embodiment of the present invention shown in FIG. 5A.

FIGS. 5, 6, and 7, show embodiments of bearing assemblies or stabilizers for a direct drive pump embodiment which does not utilize a drive tube according to the present invention. In each of these embodiments, the bearing assembly includes a bushing attached to a rod body, with a bearing mounted in a housing, e.g., a plastic or other type housing, that closely fits the internal diameter of the production tubing. The housing, and thus, the bearing, remain fixed relative to the tubing with the rod string rotating within the bearing. FIG. 5 shows a ceramic-polymer alloy bearing example embodiment. In FIG. 5A, a polymer housing and bearing 500 are situated near a ceramic bushing 501, the ceramic bushing 501 being situated on the drive rod 502. In FIG. 5B, the polymer housing and bearing 500 surrounding the ceramic bushing 501 are shown. A resulting flow area is available outside of the polymer housing 500. In FIG. 5C, a front view of the assembly is shown in which inside the production tubing 503, a retention band 504 is used to hold the housing 500 which surrounds a portion of the drive rod 502.

Figure 6A:
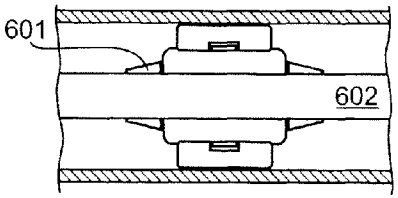
FIG. 6A shows a cross-sectional view of a stabilizer embodiment for the direct drive pump according to an embodiment of the present invention.
Figure 6B:
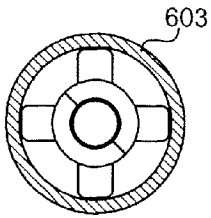
FIG. 6B shows a top view of a stabilizer embodiment for the direct drive pump according to the embodiment of the present invention shown in FIG. 6A.
Figure 6C:
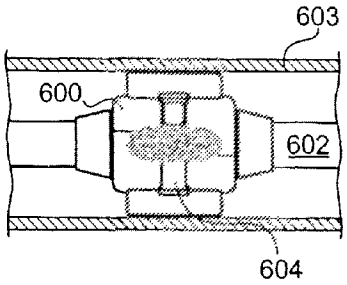
FIG. 6C shows a front view of a stabilizer embodiment for the direct drive pump according to the embodiment of the present invention shown in FIG. 6A.

FIG. 6 shows a non-corrosive bearing example embodiment. In FIG. 6A, a polymer housing and bearing 600 are situated near a molded stop 601, e.g., a molded plastic stop, the molded stop 601 being situated on the drive rod 602. In FIG. 6B, the polymer housing and bearing 600 surrounding the drive rod 602 are shown. A resulting flow area is available outside of the polymer housing 600. In FIG. 6C, a front view of the assembly is shown in which inside the production tubing 603, a retention band 604 is used to hold the housing 600 which surrounds a portion of the drive rod 602.

Figure 7A:
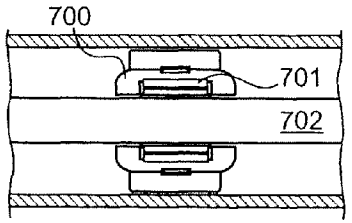
FIG. 7A shows a cross-sectional view of a stabilizer embodiment for the direct drive pump according to an embodiment of the present invention.
Figure 7B:
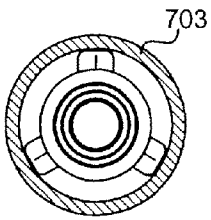
FIG. 7B shows a top view of a stabilizer embodiment for the direct drive pump according to the embodiment of the present invention shown in FIG. 7A.
Figure 7C:
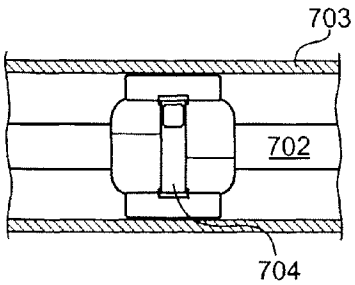
FIG. 7C shows a front view of a stabilizer embodiment for the direct drive pump according to the embodiment of the present invention shown in FIG. 7A.

FIG. 7 shows a ceramic bearing example embodiment. In FIG. 7A, a plastic housing and bearing 700 are situated near a ceramic bushing 701, the ceramic bushing 701 being situated on the drive rod 702. In FIG. 7B, the plastic housing and bearing 700 surrounding the ceramic bushing 701 are shown. A resulting flow area is available outside of the plastic housing 700. In FIG. 7C, a front view of the assembly is shown in which inside the production tubing 703, a retention band 704 is used to hold the housing 700 which surrounds a portion of the drive rod 702.

In embodiments of the present invention, the bearing material to be used depends upon the wear and lateral load expected at the bearing's location within the well. For example, where high lateral loading is expected due to bore hole deviations, ceramic or even carbide bearings can be used. Or, for example, where not much side loading is expected, simpler and less expensive polymer alloy bearings can be used. The bearing housing material can be plastic, nylon, polymer alloy, or some other strong, chemically inert material.

In embodiments of the present invention, various types of bearings can be used. Determining which bearing type to use can depend upon the expected load, depth of the pump, use of a drive tube, and other considerations. In FIGS. 5 to 9, the bearings differ in the provision for fluid flow around the bearing housing. For example, when a drive tube is not used, the bearings are exposed to the production fluid flow, thus the area open to flow between the bearing housing and the inside of the production tubing should be maximized to reduce pressure losses as the fluid flows past the bearings. See, e.g., FIGS. 5 to 7. Or, for example, when a drive tube is used, the fluid in the tube is virtually stagnant, and the bearing housings need only be fluted enough to allow for a low rate flow communication throughout the drive string. See, e.g., FIGS. 8 and 9.

FIGS. 8 and 9 show embodiments of bearing assemblies or stabilizers for a direct drive pump embodiment having a drive tube according to the present invention. In each of these embodiments, the bearing assembly includes a bushing attached to a rod body, with a bearing mounted in a housing, e.g., a plastic or other type housing, that closely fits the internal diameter of the drive tube housing. The housing, and thus, the bearing, are situated to remain fixed relative to the drive tube housing with the rod string rotating within the bearing.

Figure 8A:
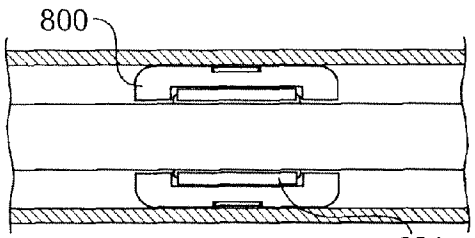
FIG. 8A shows a cross-sectional view of a stabilizer embodiment for the direct drive pump according to an embodiment of the present invention.
Figure 8B:
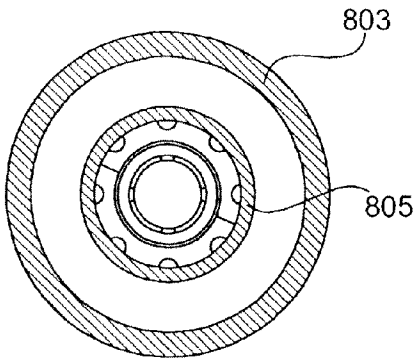
FIG. 8B shows a top view of a stabilizer embodiment for the direct drive pump according to the embodiment of the present invention shown in FIG. 8A.
Figure 8C:
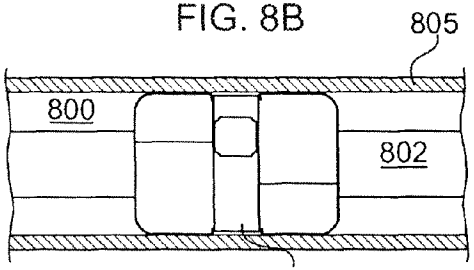
FIG. 8C shows a front view of a stabilizer embodiment for the direct drive pump according to the embodiment of the present invention shown in FIG. 8A.

FIG. 8 shows a ceramic-polymer alloy bearing example embodiment. In FIG. 8A, a polymer housing and bearing 800 are situated near a ceramic bushing 801, the ceramic bushing 801 being situated on the drive rod 802. A drive tube 805 surrounds this assembly. In FIG. 8B, the production tubing 803 surrounds the drive tube 805 which surrounds the bearing assembly. In FIG. 8C, a front view of the assembly is shown in which within the drive tube 805, a retention band 804 is used to hold the housing 800 which surrounds a portion of the drive rod 802.

Figure 9A:
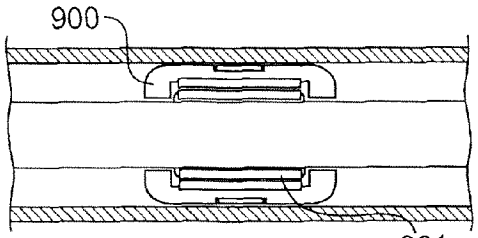
FIG. 9A shows a cross-sectional view of a stabilizer embodiment for the direct drive pump according to an embodiment of the present invention.
Figure 9B:
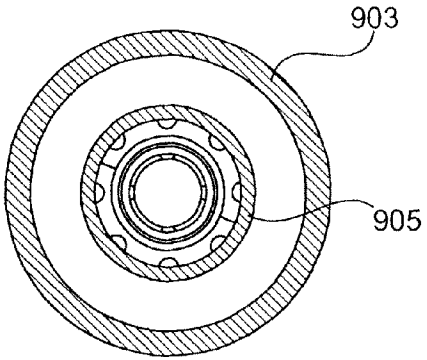
FIG. 9B shows a top view of a stabilizer embodiment for the direct drive pump according to the embodiment of the present invention shown in FIG. 9A.
Figure 9C:
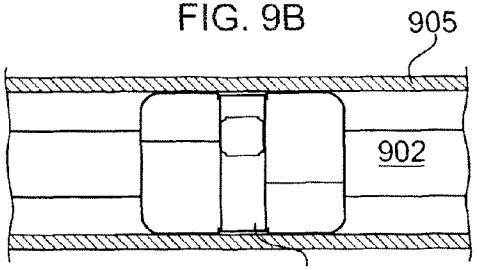
FIG. 9C shows a front view of a stabilizer embodiment for the direct drive pump according to the embodiment of the present invention shown in FIG. 9A.

FIG. 9 shows a ceramic bearing example embodiment. In FIG. 9A, a plastic housing and bearing 900 are situated near a ceramic bushing 901, the ceramic bushing or bearing 901 being situated on the drive rod 902. A drive tube 905 surrounds this bearing assembly. In FIG. 9B, the production tubing 903 is shown surrounding the drive tube 905 which surrounds the bearing assembly. In FIG. 9C, a front view of the assembly is shown in which inside the drive tube 905, a retention band 904 is used to hold the housing 900 which surrounds a portion of the drive rod 902.

Figure 1B:
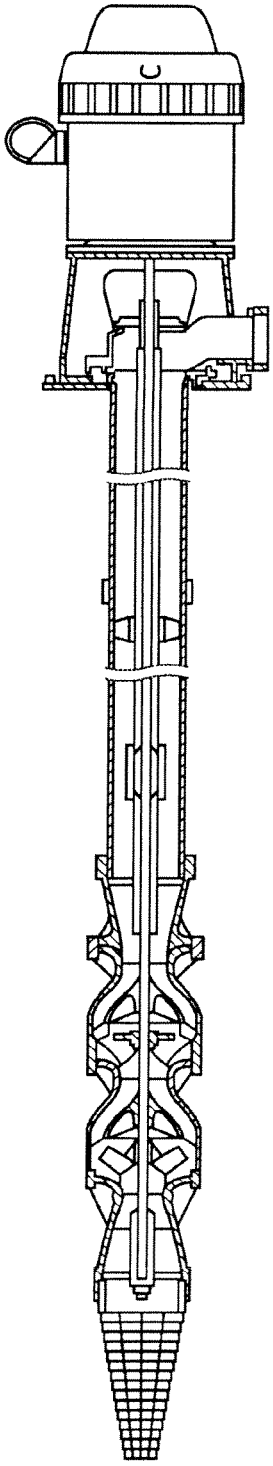
FIG. 1B shows a line shaft pump with oil lubricated bearings.

In embodiments of the present invention, the bearing assembly, or configuration, provides that the tubulars and the drive string can be run separately and sequentially, rather than simultaneously as done in currently available pump systems. In embodiments of the present invention, the bearing assembly allows for individual segments of pipe and drive string to be much longer since the bearings are not attached to the tubulars' couplings. Thus, the couplings can be spaced much more widely, without having to adjust for the earlier necessary placement of bearings. Accordingly, this allows for relatively easier service and maintenance of the pump system. For example, when the pump requires service, the drive rods and/or tubulars can be pulled from and subsequently rerun into the well in large lengths, e.g. several feet, 100 foot lengths, etc., at a time. Further, in an embodiment, the tubing couplings are threaded, instead of having flange couplings, e.g., as shown in FIGS. 1A and 1B, thus greatly improving seal integrity and speed of installation.

In an embodiment of the present invention, mounting such bearing assemblies on a drive rod allows the bearings to be located optimally as required by the conditions in the well. For example, such conditions may include rod tension and potential side loads in the well due to, e.g., borehole deviation. In an example, the rotational stability of a drive string is a function of rod tension. That is, the higher the tension, the more stably the rod will rotate. However, at the bottom of the hole, near the pump, the rod may have little tension. Thus, at this location of the pump in the well, the bearing spacing needs to be the closer in space in order to assure stable rotation. Likewise, proceeding up the hole toward the surface, the tension of the rod increases as the weight of the rod hanging below effectively is increased. Thus, the spacing of the bearings can be increased in this area. That is, where the rod tension is greatest, the relative bearing spacing along the drive rod may be the widest and still be adequately effective. In an embodiment of the present invention, an optimized drive rod string has bearings spaced according to the requirements dictated by the rod tension.

In a practical situation, wells—oil or water—are frequently neither perfectly straight nor vertical. Thus, a drive rod rotating within tubing with a small diameter may be forced to the side by deviations of the direction of the well, causing lateral loads on the bearings situated in and/or near the area of the deviation. The drive rod bearings are principally designed to keep the rod string rotating stably, and are normally expected to exposed to only small lateral loads. However, if side loads are expected to be unusually high due to borehole deviations, special bearings designed for side-load resistance can be installed in those areas where high lateral load is expected, e.g., the ceramic bearings as shown in FIGS. 5 to 9.

In embodiments of the present invention, relatively easy maintenance is needed due to the structure of the pump system. In an embodiment, the drive rod(s) can be removed without having to remove the other components. Such allows for relatively easy "tuning" or adjustment of the pump system for changing/changed operational conditions, or for normal maintenance. For example, if an operation condition such as pump speed is changed, the drive rod(s) can be replaced with other drive rod(s) having a more useful bearing type, configuration, and/or distribution. For example, if the pump speed is increased in order to increase liquid production, the drive rods can be easily replaced with one with a different distribution of bearings that is designed for the higher rotational speed. Likewise, if there is a failure in one or more of the drive rods, a replacement drive rod(s) can be quickly run downhole thus minimizing downtime.

Embodiments of the present invention provide for pumping at greater depths. Presently available line shaft pump systems typically have a head capacity of less than 1500 feet, and are run to depths of less than 1000 feet. The relatively short length of the pipes and drive shaft results in a small amount of stretch by the components due to, e.g., water column weight and/or pump thrust, during operation. Such stretch allows the supporting thrust bearing for the drive shaft to be located at the surface. See, e.g., FIGS. 1A and 1B, described above. This allows for small manual adjustments to the relative length of those components so that the pump impellers—which are fixedly attached both torsionally and axially to the drive shaft—turn freely. In embodiments of the present invention, however, given the greater depth of the components allowed, and consequently the greater hydrostatic forces, there is a much greater relative movement between the production tubing to which the pump is attached and the drive rods and/or drive tube, allowing for a more flexible range of manual adjustment.

Figure 10:
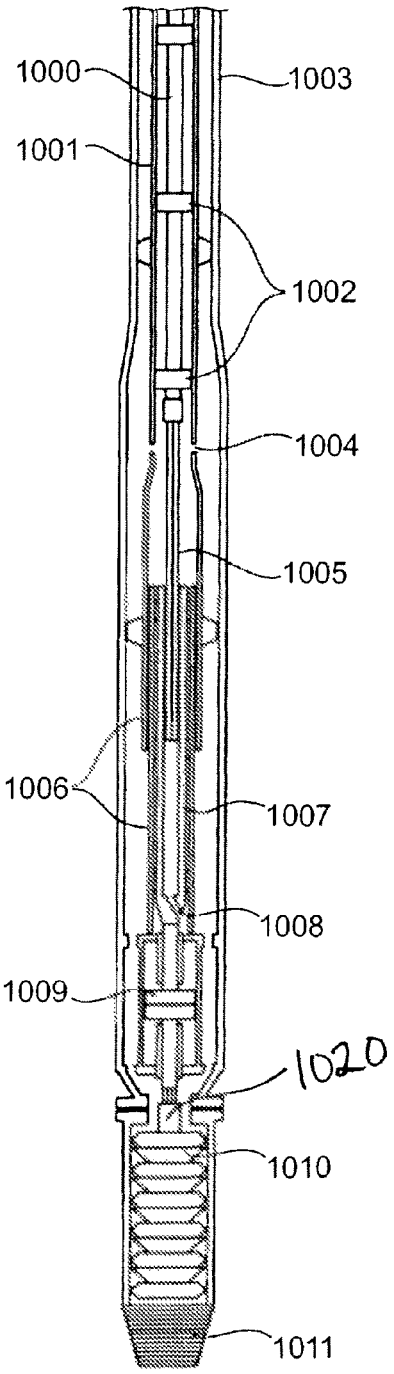
FIG. 10 shows an embodiment of a direct drive pump bottom hole assembly with a drive tube according to the present invention.

In FIG. 10, an embodiment of the direct drive pump hole assembly having a drive tube according to the present invention is shown. In such an embodiment, the pump drive shaft thrust bearing can be placed immediately above or below the pump. The pump drive shaft and rotors are driven by the drive rod(s) 1000 via a spline coupling or spline rod connector 1005 that allows for significant relative vertical movement of production tubing and the drive rod(s) 1000 while allowing the pump drive shaft and rotors to remain axially fixed relative to the pump body. In an embodiment, there is an additional thrust bearing located at the surface to handle the weight of the drive string. See, e.g., FIG. 2. In FIG. 10, the production tubing 1003 surrounds the drive tube 1001 which surrounds the drive rod 1000. Stabilizers 1002 are located on and spaced to support the drive rod 1000. Within the drive tube 1001 itself, is a bottom drive tube vent 1004. FIG. 10 further shows the relationship and relative locations of a seal bore drive tube connection 1006, stab-in receiver 1007, stab-in receiver vent 1008, thrust bearing 1009, pump 1010, and pump intake 1011.

Figure 11:
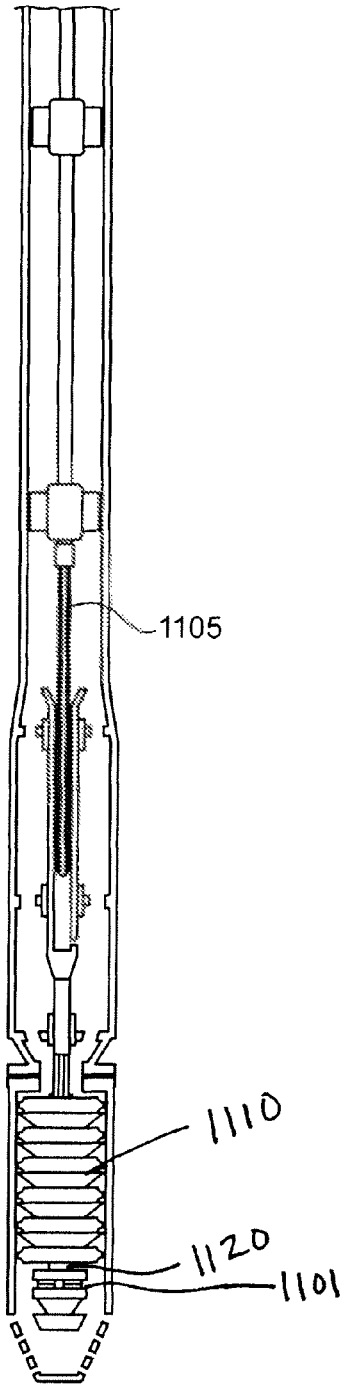
FIG. 11 shows an embodiment of a direct drive pump bottom hole assembly without a drive tube according to the present invention.

FIG. 11 shows an embodiment of the present invention similar to that shown in FIG. 10, except without a drive tube 1001. In this embodiment, a spline coupling 1105 is still employed. Further, use of a thrust bearing 1101, e.g., a polycrystalline diamond (PCD) thrust bearing, is shown situated below the pump and above the pump intake.

Figure 12:
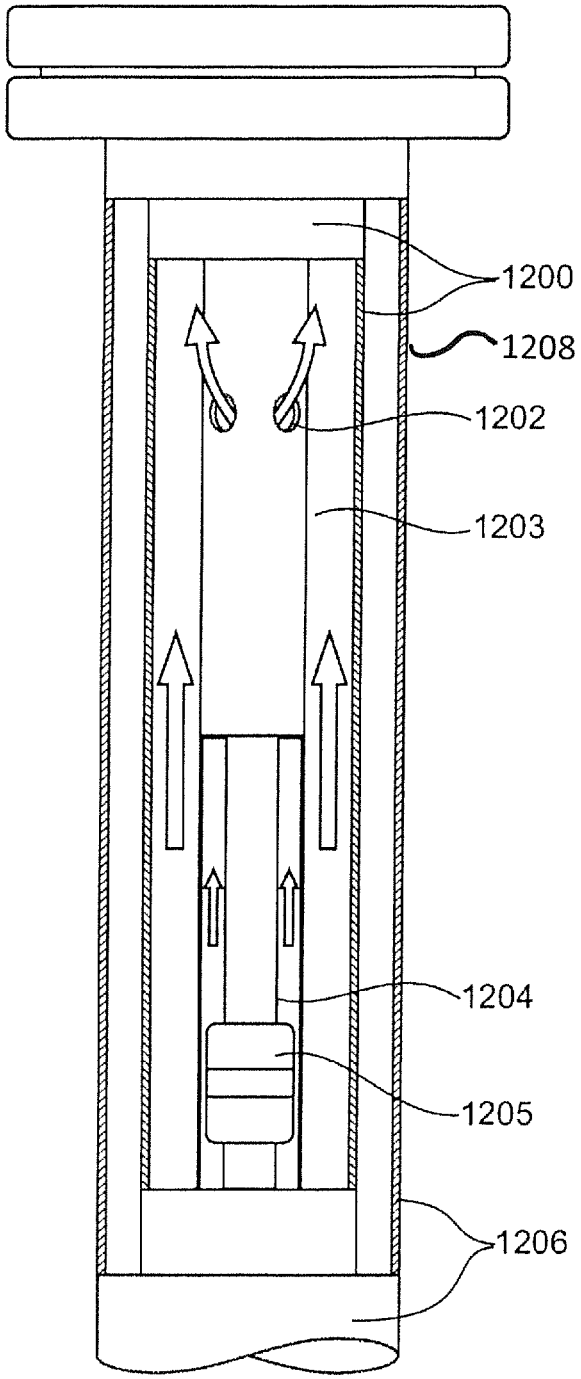
FIG. 12 shows an embodiment of a top vented drive tube according to the present invention showing details of the well head identified by reference number 12 in FIG. 1.

FIG. 12 shows an embodiment of the present invention having a top vented drive tube. FIG. 12 shows an enlarged section of the pump system just below the wellhead see reference number 12 as circled in FIG. 2. A well casing 1208 surrounds the production tubing 1200, the production tubing 1200 surrounding the drive tube 1203. The drive tube 1203 is shown having vents 1202 in its upper area to allow for fluid flow. As the drive rod 1204 located within the drive tube 1203 moves in operation, the drive rod stabilizers 1205 are located on and support the rod. In operation of the embodiment, fluid flow in the production tubing 1200, within the drive tube 1203, and from the drive tube 1203 moves upward toward the surface.

In embodiments of the present invention, various lubricants can be used for the bearings. For example, in an embodiment having a large production housing or tubing, a drive tube having a smaller diameter can be utilized to encase the drive rod. The drive tube may be centralized within the production tubing, and be used to essentially protect the drive rod from corrosion and scale deposition that might occur in the flow stream of a produced fluid. In such an embodiment, lubrication of the bearings must be chosen so as to not negatively affect other parts of the system, e.g., sealing between components, etc. For example, in some systems, oil is used as a lubricant. In such systems, an oil lubricant can be useful at relatively shallow depths. However, using an oil lubricant at relatively greater depths can cause sealing issues between the produced fluid in the production tubing and the oil in the drive tube. Such issues can occur because of the difference in the density of the lubricating oil and the produced well fluid, e.g., typically water. For example, at deep depths, e.g., 6000 feet, the pressure difference between a column of lubricating oil with a specific gravity of 0.9, and water, with a specific gravity of 1.0, is nearly 260 psi at 6000 foot depth. And, in a pumping system, if the produced fluid and the lubricating oil are to be kept separate, the seals at the bottom of the oil filled drive tube must seal against this 260 psi pressure differential at 3500 RPM. This pressure situation can present potential operational difficulties. In the alternative, one can pressure up the oil column at the surface to 260 psi so that the bottom hole pressures of the oil column and the produced fluid column are equal, or nearly so, relieving the pressure differential across the seals. This alternative also present operational difficulties. For example, if there are any changes in surface producing pressures, and during well shut-downs and start-ups, the surface pressure in the drive tube will need to be adjusted to the expected changes in bottom hole producing pressure. In another alternative, an oil lubricant having a similar density to that of water can be used so that the hydrostatic pressure in both columns is about equal at the bottom of the hole. This too presents difficulties in that such oils are synthetic, and thus, cost prohibitive. In embodiments of the present invention, these difficulties are overcome. For example, a water lubricated drive shaft in an embodiment of the present invention provides the benefits of the oil lubricated system without the operation difficulties, lubricant costs, and/or pressure balancing issues. The water lubricated system involves the drive shaft turning within a small diameter drive tube, and equipped with closely spaced bearings to provide rotational stability, as discussed herein. In an embodiment, the drive tube is not sealed off from the produced fluid. The produced fluid fills the drive tube and serves as the bearing lubricant. In such an embodiment using water as a lubricant, bearings designed for water lubrication can be used. Such bearings can designed using ceramic, carbide, or polymer alloy bearings, depending upon the load and wear requirements, as discussed herein. As shown in FIG. 12, the drive tube is vented to the production flow line at the surface to expel oil or gas that collects in the tub, and to allow the rate of flow up the drive tube to be controlled. In an embodiment, the drive tube is vented into the production tubing below the wellhead, allowing produced fluid to flow continuously up the drive tube. This can improve lubrication and/or improve the cooling of the bearings. In an embodiment, using a produced fluid filled drive tube can provide both cost and reliability benefits. In this embodiment, the drive shaft seals at the pump assembly are not needed. Instead, a bushing, e.g., carbide, is used to center the shaft at the bottom of the drive tube. The drive tube is vented at the bottom to allow the free movement of produced fluid into the drive tube, assuring that the drive shaft bearings are always immersed in fluid. In an embodiment, if the produced fluid is either corrosive or prone to scale deposition, the production line vented option can be used, as the flow rate up the drive tube could be closely controlled so that the fluid in the drive tube would be essentially stagnant. Thus, any potential for corrosion or scale formation on the drive string and/or bearings is greatly reduced. In such an embodiment, any remaining scale and corrosive components in the resulting stagnant column of water would have minimal effect given the lack of continuous movement.

In an embodiment, the drive tube is open to the pump outlet, thus, when it is completely filled with liquid, the pressure in the tube at the surface will be equal to the pump outlet pressure less the hydrostatic pressure exerted by a static liquid column. The pressure at the production tubing outlet at the surface will be equal to the pump outlet pressure less the hydrostatic pressure exerted by a static liquid column less the frictional pressure drop due to fluid flow in the production tubing. Thus, as long as there is flow in the tubing, the pressure at the top of the drive tube will be greater than the surface production tubing pressure, the difference being the pressure drop due to flowing friction. This difference can be used to purge the gas that will naturally accumulate at the top of the drive tube. Since the drive tube is open to the well's production fluid, some gas and/or oil may migrate up the drive tube during production. Eventually, the oil and/or gas will completely displace the water in the drive tube. The situation is more serious if gas fills even a portion of the tube since the upper bearings can become starved of liquid lubricant, resulting in eventual bearing failure.

In an embodiment, a drive tube can be fitted with vent line to the production tubing outlet, and the line can be equipped with a pressure regulator that opens when the pressure differential between the drive tube and the production tubing exceeds a set value. In the situation of possible accumulation of oil and/or gas in the drive tube, the pressure setting for the pressure regulator may need to be set after taking into account a higher than the expected friction loss pressure drop, so that the valve opens only after such accumulations occur. Thus, as oil and gas accumulate at the top of the drive tube, the pressure-regulated valve can be set to open periodically to vent some of the oil and gas from the tube, keeping a constant amount of water in the drive tube so that the bearings are always lubricated.

In an embodiment where neither corrosion nor scale deposition is of great concern, then the drive tube-venting embodiment can be used. In this embodiment, the drive tube is vented at the bottom, but there is an additional drive tube vent into the production tubing just below the wellhead as shown in FIG. 12. During production operations, there may be a significant frictional pressure drop in the production tubing between the bottom hole and the surface, due to the high rate of flow in the production tubing. Consequently, there is a greater fluid pressure inside the drive tube at the surface than in the adjacent production tubing. This differential can be used to force a low rate fluid to flow up the drive tube and out the top vent, resulting in a continual circulation of produced fluid up the drive tube, lubricating and cooling the bearings. Any oil and/or gas entering the drive tube would also pass through the top vent, eliminating the chance of gas accumulation causing lack of adequate lubricant, as described above.

In the embodiments, an effective cooling and lubrication of the stabilizer bearings is provided by the constant flow of water. See, e.g., FIG. 12. Such cooling and lubrication may be critical in deviated well situations, since the stabilizer bearings experience heavier side loads due to the bending of the drive string. In an embodiment, the production line venting also can provide continuous flow of produced fluid up the drive tube to both cool the bearings situated in that area. Further the production line venting can provide for continuous purging of any oil and/or gas that accumulates in the drive tube by merely opening a control valve to allow the desired amount of liquid to continuously flow up the drive tube and into the production flowline.

Figure 13:
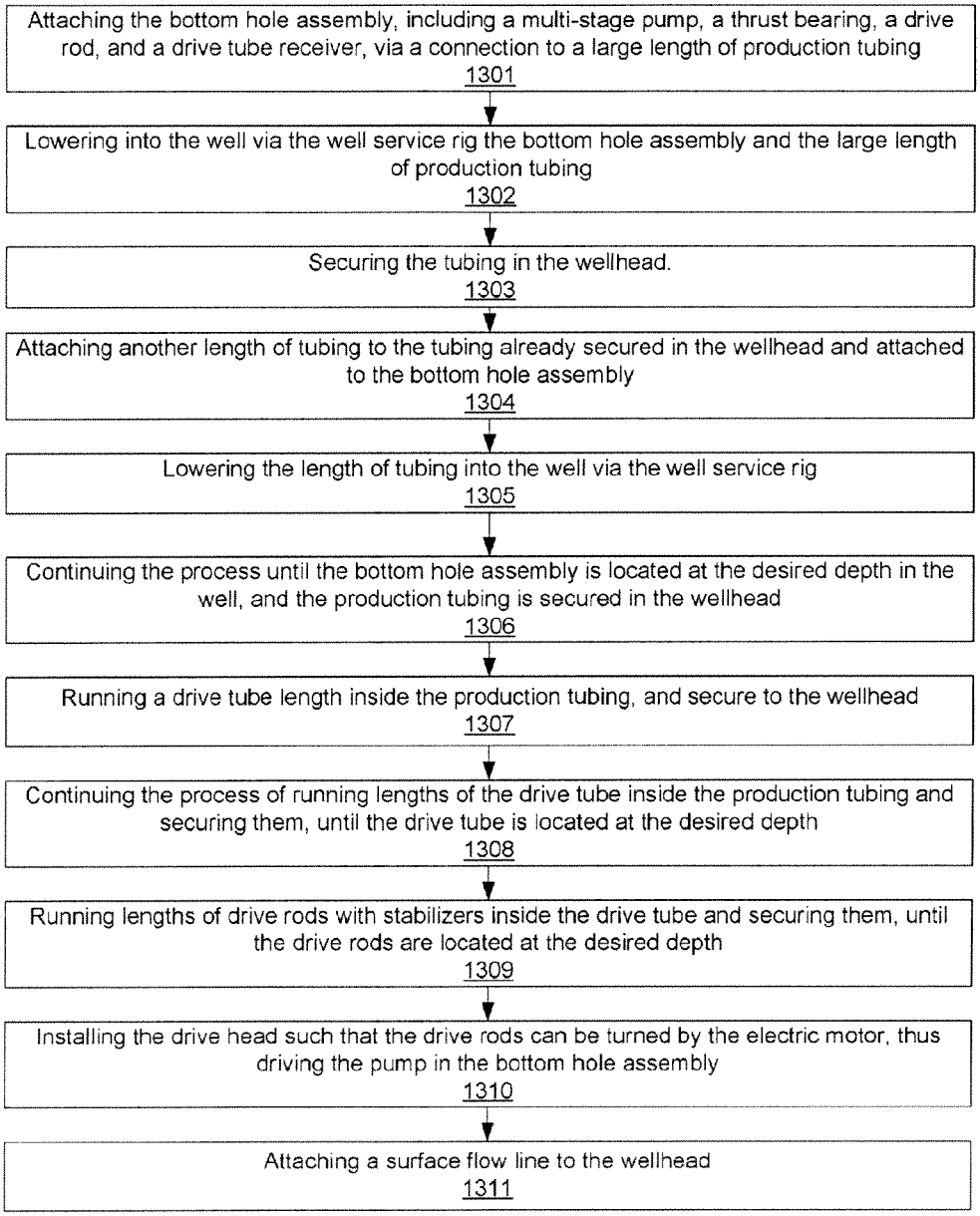
FIG. 13 shows an embodiment method for installing a direct drive pump according to the present invention.

Embodiments of the present invention facilitate easier installation of a well pump. FIG. 13 shows an example method for installing a direct drive pump, the direct drive pump having a drive tube and a drive rod such as the embodiments illustrated in FIGS. 2 and 7. Generally, in an oilfield operation, a pump assembly is installed in a well using a well service rig. The well service rig has a derrick, draw works, and accessory equipment that allows the running in and pulling out of tubulars and other equipment for use in a well. The bottom hole assembly, including a multi-stage pump, thrust bearing, and drive rod and drive tube receiver, is attached via a connection, e.g., a threaded connection, to a length of production tubing 1301. The length of production tubing typically includes two joints of tubing, each 30 feet in length, and connected together via, e.g., a threaded connection, thus forming a stand of tubing that is about 60 feet long. The pump assembly and single stand of tubing are lowered into the well 1302 via the well service rig for about 60 feet, and the tubing is secured in the wellhead 1303. Another 60 foot stand of tubing is attached 1304, via, e.g., a threaded connection, to the stand that is secured in the wellhead and which is attached to the bottom hole assembly. The entire assembly is lowered 1305 a further 60 feet and another stand is attached to the production tubing. This process is continued until the bottom hole assembly is located at the desired depth in the well 1306, and the production tubing is secured in the well head. Next, the drive tube, which consists of 60 foot stands (two 30 foot joints joined via a threaded connection) of smaller diameter tubing is inserted into the production tubing 1307, and run to bottom in a similar fashion as the production tubing and bottom hole assembly was run and secured in the wellhead 1308. The drive string tube is equipped with centralizers to locate it concentrically inside the production tubing See, e.g., FIGS. 2, 3. The drive string is also equipped with a close fitting male stab-in member at the bottom, which fits into the drive tube seal bore receiver in the bottom hole assembly. This seal bore assembly locates the drive tube so that it is centered around the drive rod receiver within the bottom hole assembly (see, e.g., FIG. 10), while also allowing relative vertical movement between the drive tube and bottom hole assembly. The drive rods with stabilizers, in 50 to 75 foot stands, are then run inside of the drive tube, in a manner similar to how the drive tube was run 1309. The drive rods are typically 25 feet or 30 feet in length, and are attached to one another via threaded connections. The drive rod string is run to bottom and the splined rod connector is stabbed into the drive rod stab-in receiver in the bottom hole assembly. See, e.g., FIG. 10. This splined connection allows the rod to rotationally drive the centrifugal pump but provide for relative vertical movement between the drive rods and the bottom hole assembly. The direct drive pump which does not use a drive tube is installed in the same manner. The difference being that no drive tube is installed in the direct drive pump. Instead, the drive rod string is run directly after the bottom hole assembly and production tubing string are run to the proper depth and secured in the well head. The drive head is then installed such that the drive rod can be turned by the electric motor (see, e.g., FIG. 2), thus driving the multi-stage centrifugal pump in the bottom hole assembly 1310. The surface flow line is attached to the well head 1311 and the pump is ready for operation. The surface flow line can then be used to transport well fluids lifted by the pump to any desired location, e.g., nearby storage container, etc.

The above described direct drive pump system, includes a downhole multi-stage centrifugal pump (210 in FIG. 2, 1010 in FIGS. 10, and 1110 in FIG. 11) that is directly driven from the surface via a rotating rod drive string (206 in FIG. 2, 1000 in FIGS. 10, and 1100 in FIG. 11) and a downhole thrust bearing (208 in FIG. 2 and 1101 in FIG. 11). There are two principal types of multi-stage centrifugal pumps termed "floaters" and "compression pumps." These pumps differ in how the downward thrust of the pump rotors is handled during operation. If a floater pump is utilized, then the thrust bearing will carry only the thrust load of the pump drive shaft. In contrast, if a compression pump is being employed, that bearing will carry and transfer to the tubing (See for example 207 in FIG. 2, 1003 in FIG. 10), both the thrust loads of the rotors and of the drive shaft. In a floater pump, each rotor has its own thrust bearing or washer, which transfers the rotor thrust directly to the pump body, and hence to the tubing. The rotors in a floater pump are attached to the pump drive shaft in torsion only, via a key-keyway arrangement, and are free to slide vertically on the pump driving shaft. The thrust of the individual rotors is therefore isolated from the drive shaft. The downward thrust on the driveshaft, due to the pressure differential generated by the pump action, is typically carried by a separate thrust bearing. In compression pumps, the rotors are fixedly attached to the drive shaft, so the shaft carries the downward thrust of the pump rotors. The combined downward thrust of the pump rotors, plus the downward thrust on the shaft due to the pump differential pressure, is carried by a single thrust bearing. The rotors in a compression pump do not each have their own thrust bearing or washer.

Figure 14A:
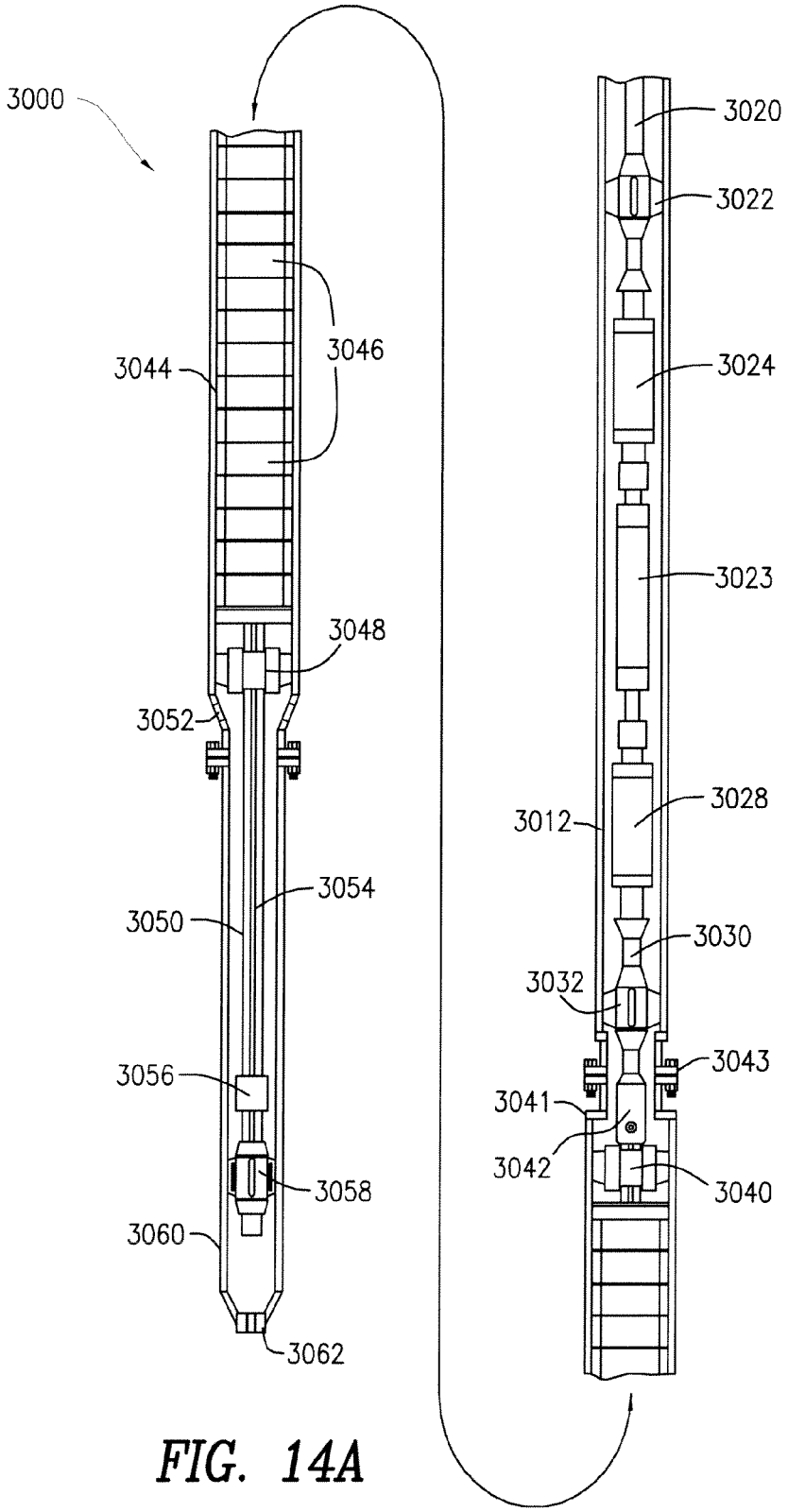
FIG. 14A shows an embodiment of a direct drive pump bottom hole assembly without a drive tube according to the present invention in a lowermost vertical position.
Figure 14B:
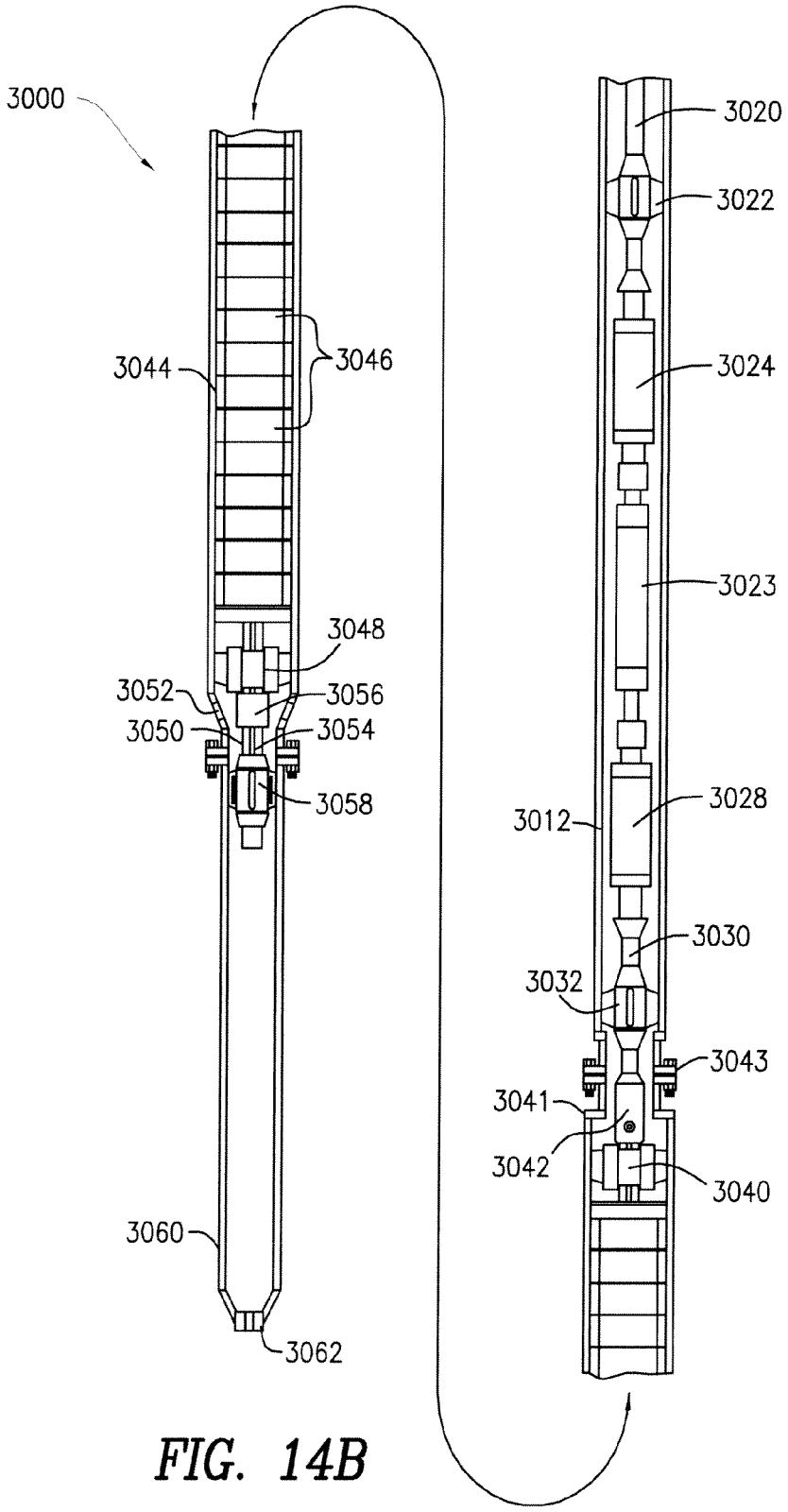
FIG. 14B shows an embodiment of a direct drive pump bottom hole assembly without a drive tube according to the present invention in a uppermost vertical displacement.

The drive rod string is powered by a prime mover (See for example 200 in FIG. 2) at the surface, and is connected to the pump drive shaft (1020 in FIG. 10, 1120 in FIG. 11) via a spline or similar torsional connection (1005 in FIG. 10, 1105 in FIG. 11). The rod drive string is not connected in tension to the downhole assembly as it does not carry any tensional loads generated by the down thrust of the pump components and has limited freedom of vertical movement within the spline connection. This limited movement is required to allow for the small relative vertical movements between the drive string and the downhole assembly that can occur during operation. The downhole thrust bearing which is attached to the pump drive shaft is designed to carry any pump induced thrust loads. The thrust bearing transfers those loads to the tubing (See for example 207 in FIG. 2, 1003 in FIG. 10) which is attached to the downhole assembly Referring now to FIGS. 14A and 14B is a basic layout of a no-thrust bearing direct drive pump configuration 3000. FIG. 14A shows a pump drive shaft 3050 in a lowermost vertical position and FIG. 14B shows the pump configuration 3000 in an uppermost position. FIG. 14B shows a lower displacement limiter 3056 contacting the lower pump shaft bearing 3048 limiting further upward axial travel of the drive shaft 3050.

Looking at FIG. 14A and starting at a bottom or downhole direction of the configuration 3000 with pump drive shaft lower housing 3060 is the pump drive shaft 3050. The housing 3060 accommodates and protects the pump drive shaft 3050 when at its lowermost axial travel (see FIG. 14A), as well as forming a structurally rigid tube for the pump drive shaft lower stabilizer 3058 to bear against. This stabilizer 3058 is required to provide rotational stability of the extension of the drive shaft 3050 below the lower pump drive shaft bearing 3048 when at this lowest position, as shown in FIG. 14A.

At the end of the drive shaft lower housing 3060 is a small inlet port 3062. This port 3062 provides a modest but continuous upward flow of produced fluid to prevent the accumulation of solids in the lower housing 3060. Note, also, a pump drive shaft torsion key 3054 set in a longitudinal keyway machined into the pump drive shaft 3050. This key 3054 engages a keyway (not shown) machined into the inside surface of the bores through each pump rotor, and connects the rotors to the pump drive shaft 3050 in torsion. Fixedly attached to the pump drive shaft 3050 is a pump drive shaft lower axial displacement limiter 3056 which stops the upward axial travel of the pump drive shaft 3050 by impacting a lower pump drive shaft bearing 3048.

The drive shaft lower housing 3060 is attached below the pump intake/inlet ports 3052 of multi-stage centrifugal pump 3044 comprised of centrifugal pump stages. At a top end of the multi-stage centrifugal pump 3044 pump, there is a upper pump drive shaft bearing 3040 against which the upper pump shaft limiter 3042 impacts stopping downward travel of the shaft 3050. This upper pump shaft limiter 3042 also doubles as the connector between the pump shaft 3050 and the lower drive rod string segment 3030 providing both torsional and tensional connection between the two shafts. In FIG. 14A, the limiter 3042 is shown hard against the upper pump drive shaft bearing 3040 stopping the shaft 3050 from any further downward axial travel.

Since the drive shaft 3050 is connected to the drive rod string 3020, the downward thrust of the pump drive shaft 3050—due to the difference between the pump intake pressure and the discharge pressure times the cross-sectional area of the shaft—can be carried by the thrust bearing at the surface that also carries the weight of the drive rod string 3020. In prior devices this downward thrust is carried by the thrust bearing at or near the pump (see 208 in FIG. 2 and 1101 in FIG. 11), rather than on the surface. Eliminating a thrust bearing downhole simplifies the design of the pump system and removes a component that frequently fails. Consequently, the only bearing the direct drive pump configuration 3000 has downhole are the simple shaft bearings 3040 and 3048 on the pump drive shaft 3050.

Looking now to the drive rod string 3020, there are spin through stabilizers 3022 and 3032, attached to provide rotational stability to the rod string 3020 during high-speed rotation. The drive rod string with stabilizers and other equipment operates within the production tubing 3012 which is attached to the pump housing 3041 via a flange connection 3043. Above the lower spin through stabilizer 3032 is a conventional rod coupling 3028 connecting the lower drive rod segment 3030, to the lower end of the rod string On-Off tool 3023. The upper end of the On-Off tool 3023 is attached to the main drive rod string 3020, via another rod coupling 3024. The On-Off tool is required to allow the drive rod string 3020 to be torsionally and tensionally connected to the pump drive shaft 3050, and also allow engagement and detachment of the drive string 3020 from the lower drive rod segment 3030, and hence from the pump drive shaft, 3050, as is needed for equipment installation and service. Immediately above this coupling 3024 is another spin-through stabilizer 3022 and further above the drive rod string 3020. Drive rod 3020 extends to the surface, and connects to the drive head where it is rotationally driven by the prime mover 200—usually an electric motor. The main drive head thrust bearing 201 carries the weight of the rod string plus any additional downthrust from the pump drive shaft 3050.

Figure 14C:
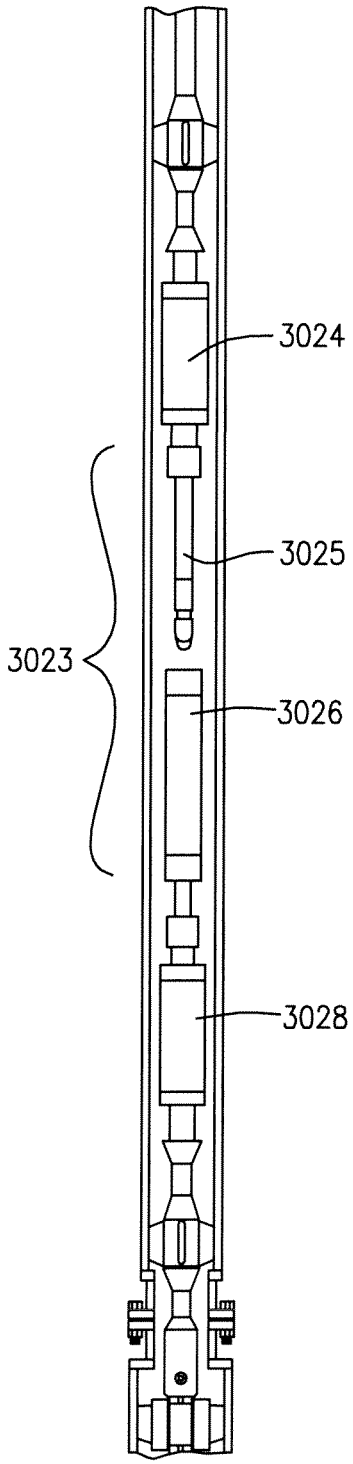
FIG. 14C shows the on-off tool of FIGS. 14A and 14B in a detached position.
Figure 15:
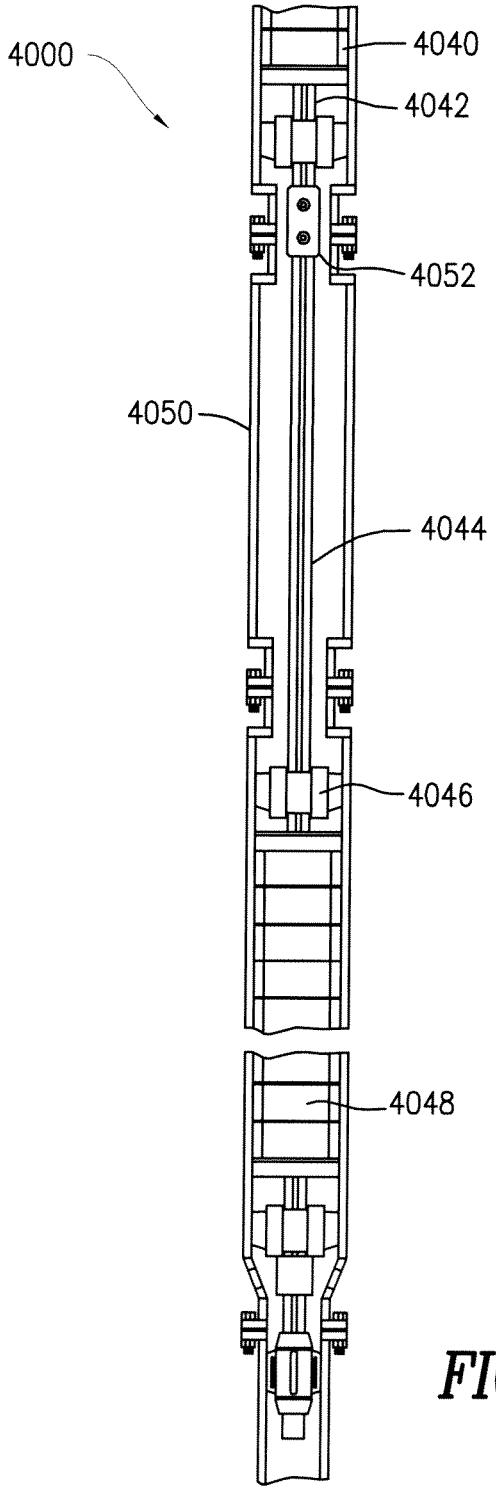
FIG. 15 shows an embodiment of a tandem direct drive pump bottom hole assembly without a drive tube according to the present invention.

Details of the On-Off tool 3023 are shown in FIG. 14C. The On-Off tool 3023 includes a On-Off tool female receiver 3026 and On-Off tool male stab-in piece 3025 both are equipped with a conventional rod coupling pin 3024, 3028, respectively, so that the On-Off tool 3025, 3026 can be placed within a rod string 3020. When the On-Off tool male stab-in piece 3025 is inserted into the female receiver 3026, it locks in place, providing both a tensional and torsional connection between the two components. The two can be disengaged by pulling in excess of a pre-set tension, which is fixed at a higher value than that expected during operation, to prevent inadvertent disengagement.

The pump configuration 3000 differs from the prior systems in that it in one preferred embodiment uses a floater-type pump. The pump configuration 3000 does not employ a downhole thrust bearing as all pump shaft downward thrust is transferred to the surface thrust bearing via the drive rod string 3020. Also, the drive rod string 3020 employs a rod string On-Off tool 3023 to connect the drive rod string 3020 to the pump drive shaft 3050 in both tension and torsion. This differs from the prior pump where the rod string is torsionally linked to the pump via a spline-like coupling. See FIGS. 10 and 11.

The pump configuration 3000, like the original embodiment, needs to have considerable freedom of axial displacement of the drive rod string 3020 relative to the downhole assembly to accommodate both the differential stretch of the tubing and rod string 3020, and the inaccuracies of space-out during installation. In FIGS. 10 and 11 showing original embodiments, this freedom of axial movement was accommodated by the relative long engagement of the spline connection between the drive rod string and the receiver. The pump configuration 3000 now has the freedom of axial movement is provided by the pump drive shaft 3050 moving axially within the centrifugal floater pump 3044 itself. Floater pumps allow the rotors to move freely axially on the drive shaft 3050 (albeit for small axial displacements), the pump rotors cannot have a tight fit to the drive shaft. Therefore, if the pump stages 3046 are axially confined within the pump housing, and the pump rotors can move freely axially, as is required by the nature of a floater pump, the pump drive shaft 3050 can freely move axially relative to the rotors and pump housing 3041, as shown FIGS. 14A and 14B.

In some applications, such as very deep installations, more stages are needed than are commercially available in a single pump housing. In those cases, a tandem pump is used. As the name indicates, two pumps are joined in tandem, so that the discharge of a lower pump feeds directly into the inlet of an upper pump. Prior art tandem pump drive shafts are joined at the junction of the two pumps, usually via a spline coupling. In typical ESP application, there is little vertical movement of the pump shafts, and therefore little vertical freedom of axial movement is required. In tandem direct drive pump 4000 of the present invention, room needs to be provided for relative vertical movement of the pump shaft 4042, 4044. This is accomplished by providing an extended pressure housing 4050 joining the upper tandem pump 4040 to the lower tandem pump 4048. The tandem direct drive pump 4000 of the present invention allows the discharge from the lower pump 4048 to flow through housing 4050 into the intake of the upper pump 4040. The housing 4050 is long enough so that the tandem pump drive shaft connector 4052 which connects in both torsion and tension the upper pump drive shaft 4042 to the lower pump drive shaft 4044 can freely move vertically throughout the allowed travel of the drive shafts 4042, 4044, as discussed above.

Thus the direct drive pump system 3000 has a housing being a well casing that contains a pump and a pump inlet at a downhole position. A drive shaft is movably attached to a multi-stage centrifugal pump, such as a floater pump, and the drive shaft is able to freely move up and down unlike with previous spline-connected direct drive pumps. The drive string rod is connected in tension and torque to the drive shaft at a lower drive string rod end by an on-off tool having male and female parts. The drive string rod via the motor at the drive head drives the pump downhole and the drive string rod carries the downward thrust weight imparted on the drive shaft via the connector, on-off tool.

It should be understood that there exist implementations of other variations and modifications of the invention and its various aspects, as may be readily apparent to those of ordinary skill in the art, and that the invention is not limited by specific embodiments described herein. Features and embodiments described above may be combined with and without each other. It is therefore contemplated to cover any and all modifications, variations, combinations or equivalents that fall within the scope of the basic underlying principals disclosed and claimed herein.

The invention claimed is:

1. A method of using a direct drive pump system comprising the steps of:

providing a pump, said pump having rotors, connecting said rotors to pump drive shafts in torque;

connecting said pump drive shaft to a drive rod string in tension; and imparting downward thrust force received by the pump drive shaft to said drive rod string;

wherein said downward thrust force carried by said drive rod string is carried at a surface of the system by a drive head.

2. The method of claim 1, wherein the pump drive shafts are slidingly connected to said rotors.

3. The method of claim 1, wherein the pump drive shafts slide up and down.

4. The method of claim 1, wherein said rotors are able to vertically slide along said pump drive shafts.

5. The method of claim 1, wherein said downward thrust force is carried by a thrust bearing at the drive head.

* * * * *